US006049278A

United States Patent [19]

Guthrie et al.

[11] Patent Number: 6,049,278

[45] Date of Patent: Apr. 11, 2000

[54] MONITOR TAG WITH PATCH ANTENNA

[75] Inventors: Warren E. Guthrie, Wheaton; Thomas Edmund Szmurlo, Palatine, both of Ill.

[73] Assignee: Northrop Grumman Corporation, Los Angeles, Calif.

[21] Appl. No.: 08/822,748

[22] Filed: Mar. 24, 1997

[51] Int. Cl.[7] ..... G08B 13/14

[52] U.S. Cl. ..... 340/572; 340/573; 343/700 MS

[58] Field of Search ..... 340/572, 573, 340/539, 825.34; 343/700 MS, 848, 846; 235/380, 382

[56] References Cited

U.S. PATENT DOCUMENTS

| | | | |
|---|---|---|---|
| 4,316,194 | 2/1982 | De Santis et al. | 343/700 MS |
| 4,430,645 | 2/1984 | Eskandry et al. | 340/572 |
| 4,589,422 | 5/1986 | James et al. | 343/700 MS X |
| 4,682,155 | 7/1987 | Shirley | 340/573 |
| 4,700,194 | 10/1987 | Ogawa et al. | 343/700 MS |
| 4,736,207 | 4/1988 | Siikarla et al. | 343/895 |
| 4,782,345 | 11/1988 | Landt | 343/727 |
| 4,821,040 | 4/1989 | Johnson et al. | 343/700 MS |
| 4,835,541 | 5/1989 | Johnson et al. | 343/713 |
| 4,926,868 | 5/1990 | Larsen | 343/700 MS X |
| 5,173,711 | 12/1992 | Takeuchi et al. | 343/700 MS |
| 5,214,410 | 5/1993 | Verster | 340/572 |
| 5,231,407 | 7/1993 | McGirr et al. | 343/700 MS |
| 5,376,943 | 12/1994 | Blunden et al. | 343/795 |
| 5,392,049 | 2/1995 | Gunnarsson | 342/42 |
| 5,410,749 | 4/1995 | Siwiak et al. | 455/280 |
| 5,416,492 | 5/1995 | Takahashi et al. | 343/771 |
| 5,552,790 | 9/1996 | Gunnarsson | 342/51 |

*Primary Examiner*—Thomas J. Mullen, Jr.

*Attorney, Agent, or Firm*—Terry J. Anderson; Karl J. Hoch, Jr.

[57] ABSTRACT

A monitor tag having a radio frequency transmitter and a patch antenna. The antenna is in communication with the transmitter and has a first conductive patch and a second conductive patch substantially parallel to each other, and separated from each other by a dielectric material in contact with both patches and having a thickness sufficient to create a gap between the patches wherein the radiation resistance will be controlled during operation of the antenna. The first conductive patch has a dimension of one-quarter or one-half wavelength, depending upon available space and desired pattern. Because the electric field is launched from the gap between the patches and is highly concentrated, bringing the monitor tag close to a metal object or attaching it thereto will have minimal impact on the impedance of the antenna. The monitor tag can be used for a number of purposes including asset protection and identification by affixing respective tags with conventional transmitters to respective metal and non-metal articles and transmitting chosen respective information about each article. Of particular applicability is a monitor tag device worn by a person such that the wearer can be monitored with respect to chosen parameters as developed for observing or regulating and transmitted or received by the antenna of the present monitor tag invention.

24 Claims, 1 Drawing Sheet

MONITOR TAG WITH PATCH ANTENNA

FIELD OF THE INVENTION

This invention relates in general to monitoring devices, and in particular to a monitor tag with a transmitter and a patch antenna, wherein the antenna has a resonant dimension of one-quarter or one-half wavelength and constructed of two generally parallel conductive patches separated by a dielectric material having a thickness sufficient to create a gap between the patches wherein radiation resistance of the antenna and therefore impedance properties are controlled.

BACKGROUND OF THE INVENTION

All radio frequency transmission and/or receiver devices require an antenna to accomplish communication connection. While conventional whip antennas commonly found on vehicles for standard radio reception or for receipt and transmittal of information are commonly used and satisfactory for such use, certain applications do not lend themselves to this type of antenna construction.

Specifically, where space consideration is critical or where visible antenna presence is not desired, a whip antenna cannot be accommodated. When such is the case, flat or patch antennas are employed.

Flat antennas are generally constructed of two generally parallel conductive sheets with the top sheet being the resonant element and the bottom sheet being the ground plane. An antenna can be either linearly or circularly polarized depending upon resonant dimensioning and feed-point characteristics. Depending upon the geographic relationship between an antenna and a receiver, linearly polarized transmissions may go unreceived if nonalignment or cross polarization occurs between the antenna and receiver. A circularly polarized antenna, however, generally reduces polarization mismatch to thereby maintain link integrity between the antenna and the receiver. In either polarity, however, when an antenna constructed according to the prior art comes in close proximity to a metal object, such as a metal wall for example, antenna impedance is adversely affected which, of course, adversely affects system performance. In like manner, impedance and resultant transmission/reception of loop or wire antennas employed in, for example, personal monitoring tag devices, is unfavorably affected in the presence of metal.

In view of the above transmission and reception difficulties encountered in the presence of a metal object, and in view of a requirement that a monitor tag must be operable both in and out of the presence of metal, it is apparent that a need is present for a monitor tag with a patch antenna having the capability to transmit and/or receive radio signals without interference from environmental surroundings that include metal objects. Accordingly, a primary object of the present invention is to provide a monitor tag having a patch antenna whose transmission and reception capabilities are substantially unaffected by the proximity of metal objects.

Another object of the present invention is to provide a monitor tag having a patch antenna wherein in the antenna generally parallel conductive sheets are separated by a dielectric material having a thickness sufficient to create a gap between the patches where the radiation resistance will be controlled during operation of the antenna.

Yet another object of the present invention is to provide a monitor tag with a patch antenna whose resonant dimension is chosen from one-quarter and one-half wavelength and with appropriate feed-point locations to thereby provide either linear or circular polarity.

Still another object of the present invention is to provide a monitor tag with a patch antenna having a back lobe radiation pattern to aid in dispersion or reception of a signal.

These and other objects of the invention will become apparent throughout the description of the invention which now follows.

SUMMARY OF THE INVENTION

The present invention is a monitor tag with a radio frequency transmitter and a patch antenna, the antenna comprising a first conductive patch and a second conductive patch substantially parallel to each other. The first and second patches are separated from each other by a dielectric material in contact with both patches and having a thickness sufficient to create a gap between the patches wherein the radiation resistance will be controlled during operation of the antenna. The first conductive patch has a dimension of one-quarter or one-half wavelength, depending upon available space and desired pattern since the one-half wavelength is more directive than the one-quarter wavelength patch. Because the electric field is launched from the gap between the patches and is highly concentrated, bringing the monitor tag close to a metal object or attaching it thereto will have minimal impact on the impedance of the antenna. Thus, and as opposed to other types of antenna construction in monitor tags where radiation resistance depends on the presence or absence of an external ground plane and thus impedance is potentially changed by metal proximity to thereby impact performance, transmitter power from the antenna in the monitor tag of the present invention is not significantly affected by metal so as to interrupt system performance.

The second conductive patch functions as a ground plane about the same size as the first conductive patch to produce a radiation pattern having a back lobe to significantly aid in the transmission or reception of a signal. Size difference between the first and second patches is relatively small when a back lobe is desired since, otherwise, as with an infinite ground plane for example, no back lobe is produced and only single lobe direction and resultant single-direction signal dispersion/reception occur. Either linear or circular polarization can be provided, dependent upon the wavelength dimension and feed location chosen for the antenna. Therefore, if antenna location is continually being changed, linearly polarized systems more readily become misaligned, or cross polarized, resulting in a signal strength drop and possible failure of the communication link. In these circumstances, circular polarization, which reduces polarization mismatch to thereby maintain link integrity, is preferred over a linearly polarized system.

While a monitor tag of the present invention can be used for a number of purposes including asset protection and identification by affixing respective tags with conventional transmitters to respective metal and non-metal articles and transmitting chosen respective information about each article, of particular applicability is a monitor tag worn by a person and having therewith a transmitter or transmitter/receiver such that the wearer can be monitored with respect to location, compliance with certain environmental requirements, actual wearing of the device, and/or a host of other parameters as developed for observing or regulating and transmitted or received by an antenna associated with the tag device of the present invention. Because such a tag device is necessarily small, a correspondingly small, conforming and light-weight antenna associated with the device is essential. Thus, and while a dielectric constant value from about 1 to 100 has utility, as a non-limiting example in the present invention, dielectric material having a dielectric-constant value of 4.0 for a 2.4 GHz antenna can be as thin as 0.030 inch thick and have side lengths of only 0.6 inch for one-quarter wavelength or only 1.30 inch for one-half wavelength dimensions. As earlier noted, if an antenna is constantly changing locations, as may well be the case for an antenna affixed to a monitor tag worn by an active person, a circular polarization system is preferred so that signal transmission/reception more readily remains intact.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
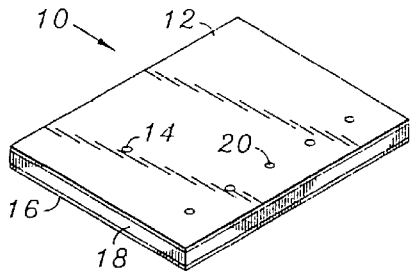
FIG. 1 is a perspective view of a one-quarter wavelength linearly polarized patch antenna.
Figure 2:
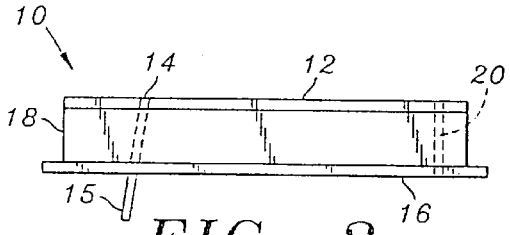
FIG. 2 is an enlarged side elevation view of the antenna of FIG. 1.

Referring to FIGS. 1 and 2, a patch antenna 10 is shown. The antenna 10 comprises a first conductive patch here being a copper first sheet 12 with a feed point 14 and conductor 15, a second conductive patch here being a copper second sheet 16, and a dielectric material 18 disposed between and in contact with the first and second sheets 12, 16. The second sheet 16 functions as a ground plane and shorting wires 20 extend from the first sheet 12 to the second sheet 16. In the embodiment here shown, the dielectric material 18 is epoxy-fiberglass (commonly called FR-4) having a thickness of 0.030 inch and a dielectric constant of about 4.0, while the first sheet 12 has a dimension of 0.6 inch×1.30 inch, thereby providing a one-quarter wavelength dimension and linear polarization. Antenna dimensions can be further reduced by employing dielectric material having a higher dielectric constant.

Figure 3:
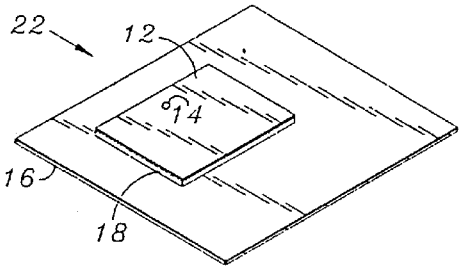
FIG. 3 is a perspective view of a circularly polarized patch antenna.

The antenna 22 of FIG. 3 is constructed of a first copper sheet 12 with a feed point 14, a second copper sheet 16, and a dielectric material 18 disposed between and in contact with the first and second sheets 12, 16. The second sheet 16 functions as a ground plane. The dielectric material 18 again has a thickness of 0.030 inch, while the first sheet 12 has a dimension of 1.30 inch×1.30 inch, thereby providing a one-half wavelength dimension and resultant linear or circular polarization depending on feed location. Specifically, if the feed point 14 is placed above where it is shown, to be substantially midway between the top and bottom of the sheet 12, linear polarization results. Once again, antenna dimensions can be further reduced by employing dielectric material having a higher dielectric constant.

Figure 5:
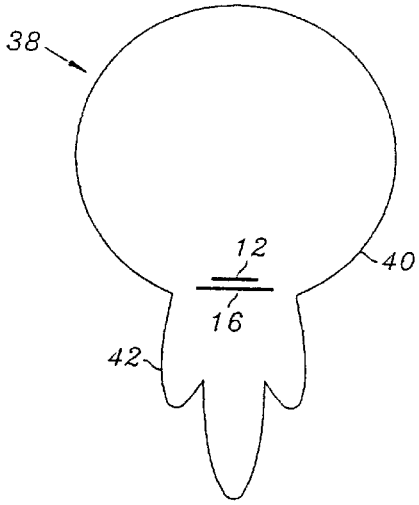
FIG. 5 is a graphic illustration of a radiation pattern from a patch antenna showing back lobe dispersion/reception.

The second sheets 16 of both the linearly polarized antenna 10 and circularly polarized antenna 22 are slightly larger than the respective first sheets 12. As earlier related, this differentiation in size between the first and second sheets 12, 16 produces a back lobe radiation pattern 38 as illustrated in FIG. 5 to thereby improve signal dispersion/reception characteristics. In particular, the radiation pattern 38 has a typical forward lobe 40 as produced with a finite ground plane. This back lobe 42 functions to increase signal dispersion or reception over a larger physical area and in a plurality of directions, thereby resulting in a greater dependability of transmitter/receiver communication.

Figure 4A:
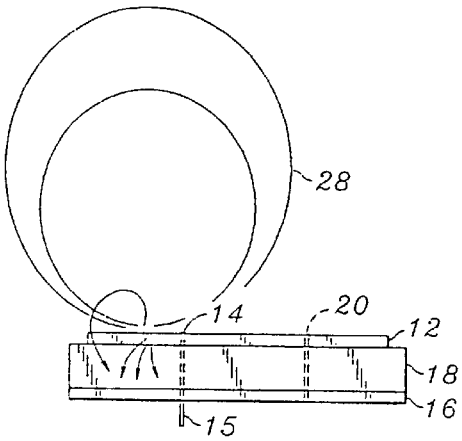
FIG. 4*a* is a side elevation view of the one-quarter wavelength linearly polarized patch antenna of FIG. 1 illustrating a linear polarization pattern.
Figure 4B:
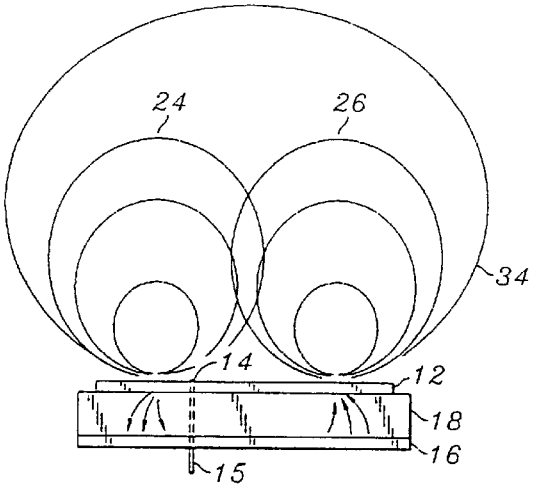
FIG. 4*b* is a side elevation view of the one-half wavelength circularly polarized patch antenna of FIG. 3 illustrating a linear polarization pattern.

FIGS. 4*a* and 4*b* illustrate the differences between linear one-quarter and one-half wavelength antenna construction and radiation patterns. In particular, the linearly polarized antenna 10 in FIG. 4*a* has shorting wires 20 extending from the first sheet 12 to the second sheet 16 (ground plane) and a singular radiation field lobe 28 with electron movement toward the second sheet 16 as indicated by the arrows. Conversely, in the circularly polarized antenna 22 in FIG. 4*b,* two element components 24, 26 radiate to form an array pattern 34, while electron movement, as shown by the arrows, occurs to and from the second sheet 16 (ground plane) having no shorting wires in communication with the first sheet 12. Since the aperture in FIG. 4*a* is smaller than the aperture in FIG. 4*b,* its pattern is slightly broader.

Figure 6:
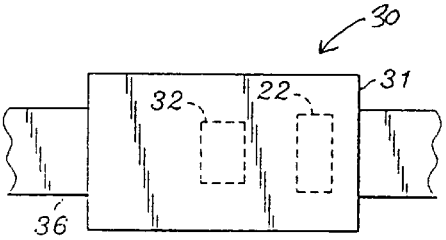
FIG. 6 is a top plan view of a monitor tag device wearable by a person and including a patch antenna.

FIG. 6 illustrates a monitor tag device 30 wearable by a person and having as part of its construction within a housing 31 a patch antenna 22 serving a radio frequency transmitter or transmitter/receiver 32 sending signals with respect to information from or for the person wearing the device 30. Non-limiting examples of such information can include location, movement, health conditions, compliance with environmental requirements or needs, and the like with respect to the person wearing the tag device 30, with this information transmitted via the antenna 22. When the tag device 30 is worn where it will experience a significant amount of movement such as attached to a wrist with a strap 36, although a linearly polarized system can be employed, a circularly polarized antenna 22 is preferred to eliminate any polarization mismatch, misalignment of antenna and receiver, etc. As earlier described, the tag device 30 will transmit irrespective of the proximity of metal to the wearer.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A monitor tag comprising:

a) a radio frequency transmitter;

b) a patch antenna with which the transmitter is in communication and comprising a first conductive patch and a second conductive patch, said patches substantially parallel to each other, shorted therebetween, and separated from each other by a dielectric material in contact with both patches and having a thickness sufficient to create a gap between the patches wherein radiation will be concentrated during operation of the antenna, and wherein the first conductive patch has a dimension of one-quarter wavelength and the second conductive patch is a ground plane of at least the same dimension; and c) a housing within which said transmitter and antenna are enclosedly disposed, said housing attachable to an object.

2. A monitor tag as claimed in claim 1 wherein in the antenna the conductive patches are constructed of copper.

3. A monitor tag as claimed in claim 2 wherein in the antenna the dielectric material has a dielectric constant between 1 and 100.

4. A monitor tag as claimed in claim 3 wherein in the antenna the dielectric material has a constant of 4 and a thickness of about 0.030 inch.

5. A monitor tag as claimed in claim 4 wherein in the antenna the ground plane is sufficiently small to produce a radiation pattern having a back lobe.

6. A monitor tag as claimed in claim 1 wherein in the antenna the dielectric material has a dielectric constant between 1 and 100.

7. A monitor tag as claimed in claim 1 wherein in the antenna the dielectric material has a constant of 4 and a thickness of about 0.030 inch.

8. A monitor tag as claimed in claim 1 wherein in the antenna the ground plane is of a size sufficiently small to produce a radiation pattern having a back lobe.

9. A monitor tag comprising:

a) a radio frequency transmitter;

b) a patch antenna with which the transmitter is in communication and comprising a first conductive patch and a second conductive patch, said patches substantially parallel to each other and separated from each other by a dielectric material in contact with both patches and having a thickness sufficient to create a gap between the patches wherein radiation will be concentrated during operation of the antenna, and wherein the first conductive patch has a dimension of one-half wavelength and the second conductive patch is a ground plane of at least the same dimension; and c) a housing within which said transmitter and antenna are enclosedly disposed, said housing attachable to an object.

10. A monitor tag as claimed in claim 9 wherein in the antenna the conductive patches are constructed of copper.

11. A monitor tag as claimed in claim 10 wherein in the antenna the dielectric material has a dielectric constant between 1 and 100.

12. A monitor tag as claimed in claim 11 wherein in the antenna the dielectric material has a constant of 4 and a thickness of about 0.030 inch.

13. A monitor tag as claimed in claim 12 wherein in the antenna the ground plane is sufficient ly small to produce a radiation pattern having a back lobe.

14. A monitor tag as claimed in claim 9 wherein in the antenna the dielectric material has a dielectric constant between 1 and 100.

15. A monitor tag as claimed in claim 9 wherein in the antenna the dielectric material has a constant of 4 and a thickness of about 0.030 inch.

16. A monitor tag as claimed in claim 9 wherein in the antenna the ground plane is sufficiently small to produce a radiation pattern having a back lobe.

17. A monitor tag device to be worn by a person, the device comprising:

a) a radio frequency transmitter;

b) a patch antenna with which the transmitter is in communication and comprising a first conductive patch and a second conductive patch, said patches substantially parallel to each other and separated from each other by a dielectric material in contact with both patches and having a thickness sufficient to create a gap between the patches wherein radiation will be concentrated during operation of the antenna, and wherein the first conductive patch has a dimension of one-quarter or one-half wavelength and the second conductive patch is a ground plane of at least the same dimension, with said patches shorted therebetween when the first patch has a one-quarter wavelength; and c) a housing within which said transmitter and antenna are enclosedly disposed, said housing having a fastener member releasably attachable to a person to thereby monitor the whereabouts of said person.

18. A monitor tag device as claimed in claim 17 wherein in the antenna the conductive patches are constructed of copper.

19. A monitor tag device as claimed in claim 18 wherein in the antenna the dielectric material has a dielectric constant between 1 and 100.

20. A monitor tag as claimed in claim 19 wherein in the antenna the dielectric material has a constant of 4 and a thickness of about 0.030 inch.

21. A monitor tag device as claimed in claim 20 wherein in the antenna the ground plane is sufficiently small to produce a radiation pattern having a back lobe.

22. A monitor tag device as claimed in claim 17 wherein in the antenna the dielectric material has a dielectric constant between 1 and 100.

23. A monitor tag device as claimed in claim 17 wherein in the antenna the dielectric material has a constant of 4 and a thickness of about 0.030 inch.

24. A monitor tag device as claimed in claim 17 wherein in the antenna the ground plane is sufficiently small to produce a radiation pattern having a back lobe.

* * * * *